US011397393B2

(12) United States Patent
Fukasawa

(10) Patent No.: US 11,397,393 B2
(45) Date of Patent: Jul. 26, 2022

(54) IMAGE FORMING APPARATUS THAT CONTROLS PRIMARY FIXING TEMPERATURE AND SECONDARY FIXING TEMPERATURE

(71) Applicant: KYOCERA Document Solutions Inc., Osaka (JP)

(72) Inventor: Yuki Fukasawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/348,437

(22) Filed: Jun. 15, 2021

(65) Prior Publication Data

US 2021/0397114 A1 Dec. 23, 2021

(30) Foreign Application Priority Data

Jun. 18, 2020 (JP) ..... JP2020-105697

(51) Int. Cl.
*G03G 15/20* (2006.01)

(52) U.S. Cl.
CPC ..... *G03G 15/2039* (2013.01); *G03G 15/205* (2013.01); *G03G 2215/208* (2013.01); *G03G 2215/2074* (2013.01)

(58) Field of Classification Search
CPC ..... G03G 15/205; G03G 15/2039; G03G 2215/2074; G03G 2215/208; G03G 2215/209
USPC ..... 399/69, 70; 219/216
See application file for complete search history.

(56) References Cited

U.S. PATENT DOCUMENTS

2013/0084092 A1* 4/2013 Ooyanagi ..... G03G 15/2039 399/69
2013/0084093 A1 4/2013 Namikata
2013/0209127 A1* 8/2013 Fujimoto ..... G03G 15/205 399/69
2014/0133878 A1* 5/2014 Okuzono ..... G03G 15/2046 399/69
2015/0253706 A1* 9/2015 Chikazawa ..... G03G 15/2039 399/69

(Continued)

FOREIGN PATENT DOCUMENTS

JP 2006-243377 A 9/2006
JP 2013-076853 A 4/2013
JP 2015-025876 A 2/2015

*Primary Examiner* — Robert B Beatty
(74) *Attorney, Agent, or Firm* — IP Business Solutions, LLC

(57) ABSTRACT

An image forming apparatus includes a fixing device, and a controller. The controller acts as a print controller, a drawing controller, and an engine controller. The print controller receives a printing request. The drawing controller identifies an image to be drawn, through image processing of a page image designated by the printing request with respect to each page, and identifies a use amount of toner required for the image to be drawn. The engine controller executes a primary fixing temperature control including controlling the fixing temperature according to color information designated by the printing request with respect to each page, and executes, after executing the primary fixing temperature control, a secondary fixing temperature control including controlling the fixing temperature according to the use amount of toner identified by the drawing controller.

4 Claims, 3 Drawing Sheets

(56) References Cited

U.S. PATENT DOCUMENTS

2016/0004195 A1* 1/2016 Ozawa ..... G06K 15/1867
399/69

* cited by examiner

IMAGE FORMING APPARATUS THAT CONTROLS PRIMARY FIXING TEMPERATURE AND SECONDARY FIXING TEMPERATURE

INCORPORATION BY REFERENCE

This application claims priority to Japanese Patent Application No. 2020-105697 filed on 18 Jun., 2020, the entire contents of which are incorporated by reference herein.

BACKGROUND

The present disclosure relates to an image forming apparatus.

An image forming apparatus based on electrophotography is configured to fix a toner image transferred to a printing sheet, for example with a fixing device of a heat-pressing type. The picture quality of the toner image fixed onto the printing sheet varies depending on the fixing temperature, and therefore it is important to properly control the fixing temperature.

Some of the existing image forming apparatuses (hereinafter, "first image forming apparatus") are configured to control the fixing temperature of the fixing device, according to the basis weight and the type of the printing sheet.

Image forming apparatuses of another type (hereinafter, "second image forming apparatus") are configured to adjust the fixing temperature according to a printing mode (e.g., full-color mode, monochrome mode, or toner-saving mode), with respect to each page.

Image forming apparatuses of still another type (hereinafter, "third image forming apparatus") are configured to control the fixing temperature, according to the amount of toner applied to the printing sheet.

SUMMARY

The disclosure proposes further improvement of the foregoing techniques.

In an aspect, the disclosure provides an image forming apparatus including a fixing device, and a controller. The fixing device fixes a toner image onto a printing sheet to which the toner image corresponding to an image to be drawn by printing. The controller includes a processor, and acts as a print controller, a drawing controller, and an engine controller, when the processor executes a control program. The print controller receives a printing request. The drawing controller identifies an image to be drawn, through image processing of a page image designated by the printing request with respect to each page, and identifies a use amount of toner required for the image to be drawn. The engine controller controls a fixing temperature of the fixing device. The engine controller executes a primary fixing temperature control including controlling the fixing temperature according to color information designated by the printing request with respect to each page, and executes, after executing the primary fixing temperature control, a secondary fixing temperature control including controlling the fixing temperature according to the use amount of toner identified by the drawing controller.

DETAILED DESCRIPTION

Hereafter, an embodiment of the disclosure will be described, with reference to the drawings.

Figure 1:
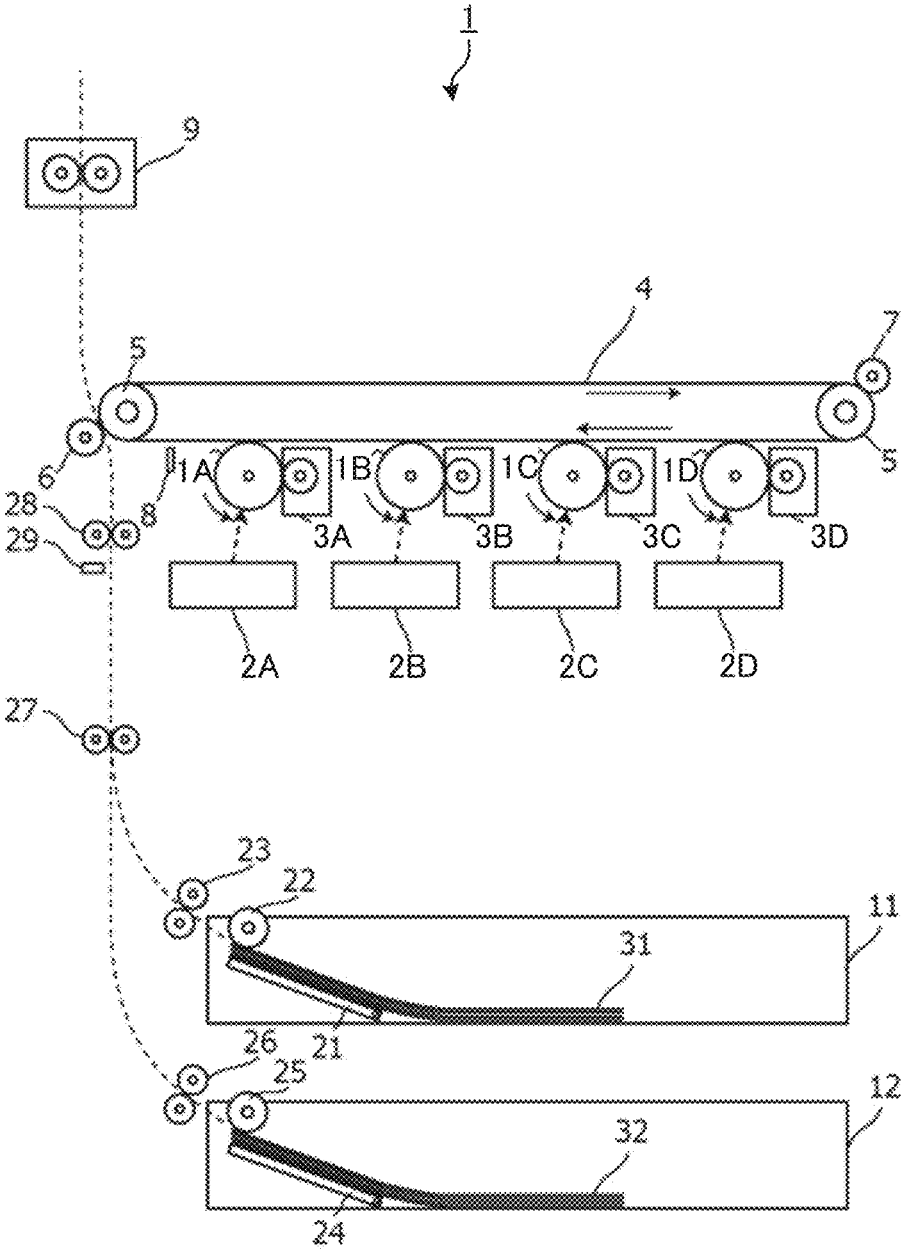
FIG. 1 is a schematic side view showing an internal mechanical structure of an image forming apparatus according to an embodiment of the disclosure.

FIG. 1 is a schematic side view showing an internal mechanical structure of an image forming apparatus according to the embodiment of the disclosure. The image forming apparatus 1 shown in FIG. 1 is an apparatus having a printing function based on electrophotography, such as a printer, a facsimile machine, a copier, or a multifunction peripheral.

The image forming apparatus 1 includes a tandem-type color developing device. The color developing device includes photoconductor drums 1A to 1D, exposure devices 2A to 2D, and developing units 3A to 3D. The photoconductor drums 1A to 1D are photosensitive bodies respectively corresponding to four colors, namely cyan, magenta, yellow, and black.

The exposure devices 2A to 2D each scan the corresponding one of the photoconductor drums 1A to 1D with laser beam, to thereby form an electrostatic latent image. The laser beam is emitted in the direction orthogonal to the rotating direction (sub scanning direction) of each of the photoconductor drums 1A to 1D, in other words in the main scanning direction. The exposure devices 2A to 2D each include a laser scanning unit having a laser diode which is the source of the laser beam, and optical elements (e.g., lenses, mirrors, polygon mirrors) that conduct the laser beam to the corresponding one of the photoconductor drums 1A to 1D.

A charger such as a scorotron, a cleaning device, and an ionizer are provided around each of the photoconductor drums 1A to 1D. The cleaning device removes residual toner from the photoconductor drum, after primary transfer. The ionizer removes static electricity from the photoconductor drum, after the primary transfer.

The developing units 3A to 3D each include a toner cartridge in which the toner of the corresponding color out of cyan, magenta, yellow, and black is loaded, and a developer that applies the toner delivered from a toner hopper in the toner cartridge, to the corresponding one of the photoconductor drums 1A to 1D. The developing units 3A to 3D each apply the toner to the electrostatic latent image on the corresponding one of the photoconductor drums 1A to 1D, to thereby form a toner image.

The photoconductor drum 1A, the exposure device 2A, and the developing unit 3A serve to develop a portion of the image corresponding to magenta. The photoconductor drum 1B, the exposure device 2B, and the developing unit 3B serve to develop a portion of the image corresponding to cyan. The photoconductor drum 1C, the exposure device 2C, and the developing unit 3C serve to develop a portion of the image corresponding to yellow. The photoconductor drum 1D, the exposure device 2D, and the developing unit 3D serve to develop a portion of the image corresponding to black.

The image forming apparatus 1 also includes an intermediate transfer belt 4, a drive roller 5, a transfer roller 6, a roller 7, and a sensor 8. The intermediate transfer belt 4 is an annular image carrier (intermediate transfer medium) disposed in contact with the photoconductor drums 1A to 1D, so that the toner image on each of the photoconductor drums 1A to 1D is transferred to the intermediate transfer belt 4, as primary transfer. The intermediate transfer belt 4 is wound around the drive roller 5, to be thereby driven to rotate in the direction from the contact position with the photoconductor drum 1D toward the contact position with the photoconductor drum 1A.

The transfer roller 6 causes the printing sheet transported thereto as will be subsequently described, to contact the intermediate transfer belt 4, so that the toner image on the intermediate transfer belt 4 is transferred to the printing sheet, as secondary transfer. The printing sheet to which the toner image has been transferred is transported to the fixing device 9. The fixing device 9 fixes the toner image, corresponding to an image to be drawn through the printing operation to be subsequently described, onto the printing sheet to which such toner image has been transferred. In this embodiment, the fixing operation is performed by heat-pressing.

The roller 7 includes a cleaning brush. The roller 7 causes the cleaning brush to contact the intermediate transfer belt 4, to thereby remove the toner remaining on the intermediate transfer belt 4, after the transfer of the toner image to the printing sheet, or after calibration.

The sensor 8 emits light to the intermediate transfer belt 4, and detects the reflected light from the surface, or from the toner pattern on the surface of the intermediate transfer belt 4. For example, the sensor 8 emits light and detects the reflected light, to and from a predetermined region on the intermediate transfer belt 4 (where a toner patch for calibration is transferred) at the time of calibration of toner gradation or toner density, and outputs an electrical signal according to the amount of the reflected light.

The image forming apparatus 1 also includes a plurality of paper cassettes 11 and 12, a transport roller 27, a resist roller 28, and a resist sensor 29. The paper cassettes 11 and 12 respectively accommodate printing sheets 31 and 32 therein. The paper cassettes 11 and 12 lift the printing sheets 31 and 32 upward with lifting plates 21 and 24, to thereby cause the printing sheets 31 and 32 to contact pickup rollers 22 and 25, respectively. The pickup rollers 22 and 25 respectively pick up the printing sheets 31 and 32 accommodated in the paper cassettes 11 and 12, one by one from the top, toward feed rollers 23 and 26. The feed rollers 23 and 26 respectively deliver the printing sheets 31 and 32, picked up by the pickup rollers 22 and 25 from the paper cassettes 11 and 12, one by one to a transport route.

The transport roller 27 is provided on the transport route, to be utilized in common by the printing sheets 31 and 32 transported from the paper cassettes 11 and 12.

The resist roller 28 temporarily detains the printing sheet being transported, and delivers the printing sheet to the transfer position between the intermediate transfer belt 4 and the transfer roller 6, at the timing for secondary paper feeding. The timing for the secondary paper feeding is determined by a controller 41 to be subsequently described, so as to allow the toner image on the intermediate transfer belt 4 to be transferred to a designated position on the printing sheet.

The resist sensor 29 is located close to the resist roller 28. The resist sensor 29 optically detects that the printing sheet has reached the resist roller 28, which corresponds to a secondary paper feeding position.

Figure 2:
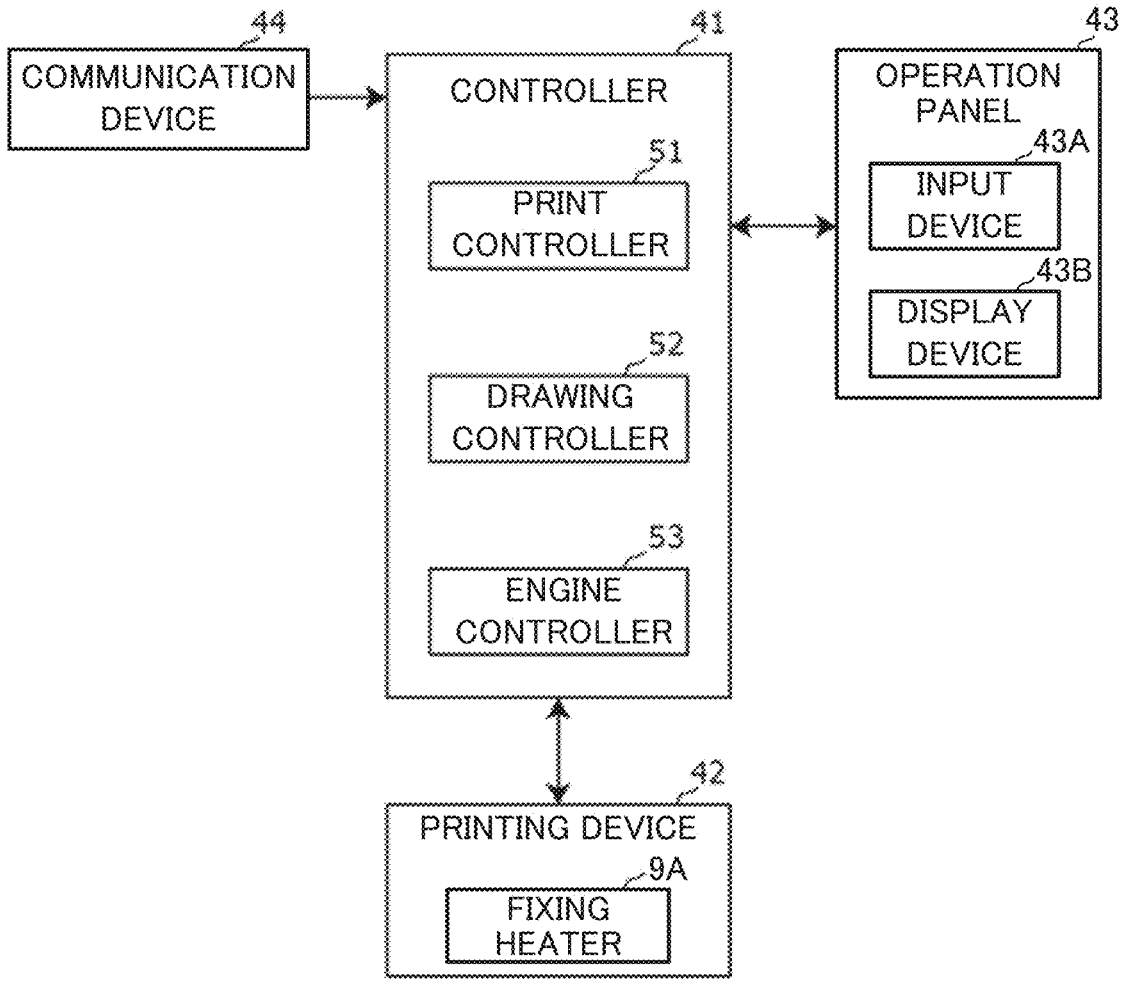
FIG. 2 is a block diagram showing an essential part of the electrical configuration of the image forming apparatus according to the embodiment of the disclosure.

FIG. 2 is a block diagram showing an essential part of the electrical configuration of the image forming apparatus 1 according to the embodiment of the disclosure. As shown in FIG. 2, the image forming apparatus 1 includes the controller 41, a printing device 42, an operation panel 43, and a communication device 44.

The controller 41 is a computer including a processor such as a central processing unit (CPU) or an application specific integrated circuit (ASIC). The controller 41 realizes the functional units, with at least one of software and hardware. The controller 41 monitors and controls the internal devices such as the printing device 42, and executes various types of data processing.

The printing device 42 is one of the internal devices, and configured to print a source image with the mechanical structure, for example shown in FIG. 1.

The operation panel 43 includes an input device 43A having a touch panel for receiving a user's operation and hard keys, and a display device 43B, for example constituted of an LCD panel for displaying an operation screen for the user.

The communication device 44 may be, for example, a wired or wireless network interface, a modem, or a peripheral equipment interface. The communication device 44 performs data communication, for example with a host apparatus.

The controller 41 acts as a print controller 51, a drawing controller 52, and an engine controller 53.

The print controller 51 receives a printing request, and executes a printing job according to the printing request received, using the drawing controller 52 and the engine controller 53. The print controller 51 receives the printing request, for example, from the host apparatus through the communication device 44.

The drawing controller 52 executes image processing (e.g., color conversion, color correction, or half toning) to a page image designated by the printing request with respect to each page, to thereby identify the image to be drawn through the printing job, and determines a toner use amount required by the image to be drawn.

In this embodiment, the drawing controller 52 identifies the number of toner dots of the image to be drawn through the printing job, and determines the toner use amount, on the basis of the number of toner dots. In the case of color printing, the drawing controller 52 identifies the toner use amount on the basis of, for example, the total sum of the number of toner dots of a plurality of color planes (in this embodiment, cyan, magenta, yellow, and black). The drawing controller 52 calculates the toner use amount from the number of toner dots, for example using a predetermined function known through experiments.

The engine controller 53 controls the drive source that drives the foregoing rollers, a bias application circuit that applies a development vias and a primary transfer bias, the exposure devices 2A to 2D, and the fixing temperature of the fixing device 9, more specifically the temperature of a fixing heater 9A, so as to form the electrostatic latent image, develop, transfer, and fix the toner image, and feed and discharge the printing sheet.

In particular, the engine controller 53 controls the primary fixing temperature, according to color information (information designating one of color printing, monochrome printing, and blank, in other words no image to be printed) designated by the printing request with respect to each page, and then controls the secondary fixing temperature, after the primary fixing temperature is executed and the toner use amount is determined, on the basis of the toner use amount determined.

The print controller 51 sets a target fixing temperature according to the color information, when controlling the primary fixing temperature. When controlling the secondary fixing temperature, the print controller 51 sets the target fixing temperature, according to the toner use amount. Here, the print controller 51 obtains the target fixing temperature from the color information or the toner use amount, for example using a lookup table or a function. The lookup table or the function is established in advance through experiments, and implemented in the print controller 51.

In this embodiment, the engine controller 53 controls the secondary fixing temperature, using both of the color information and the toner use amount. In other words, the print controller 51 sets the target fixing temperature for the secondary fixing temperature control, according to both of the color information and the toner use amount.

Further, the engine controller 53 controls the primary fixing temperature during a primary feeding of the printing sheet (while the printing sheet is transported from the paper cassette 11 or 12 to the resist roller 28), and controls the secondary fixing temperature during the secondary feeding of the printing sheet (while the printing sheet is transported from the resist roller 28 to the fixing device 9).

Figure 3:
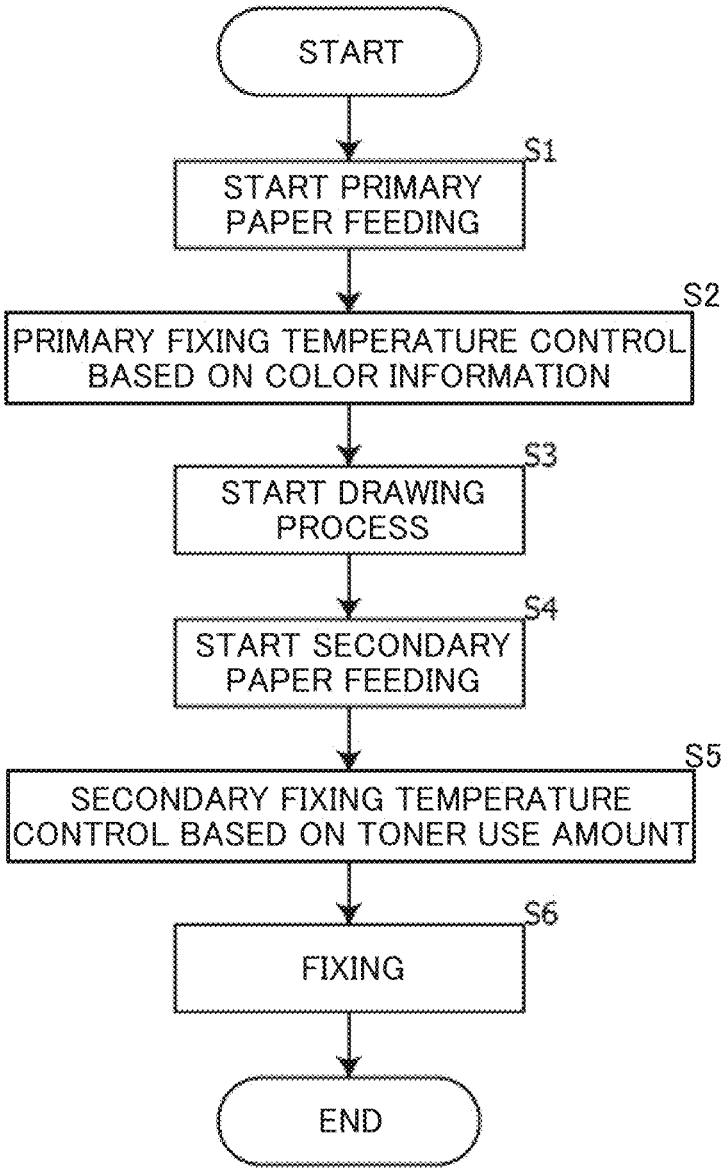
FIG. 3 is a flowchart for explaining an operation of the image forming apparatus.

Hereunder, an operation of the image forming apparatus 1 will be described. FIG. 3 is a flowchart for explaining the operation of the image forming apparatus 1.

The print controller 51 causes the engine controller 53, upon receipt of the printing request, to start the primary feeding of the printing sheet designated by the printing request (step S1). After step S1, the print controller 51 sets the target fixing temperature for the primary fixing temperature control (hereinafter, "primary target fixing temperature") according to the color information, notifies the primary target fixing temperature to the engine controller 53, and causes the engine controller 53 to start the primary fixing temperature control (step S2). The engine controller 53 controls the primary fixing temperature, so as to match the temperature of the fixing heater 9A with the primary target fixing temperature. In other words, in the primary fixing temperature control, the engine controller 53 adjusts the temperature of the fixing heater 9A so as to accord with the primary target fixing temperature, from the current temperature thereof.

The print controller 51 also causes the drawing controller 52, upon receipt of the printing request, to execute the necessary image processing and the calculation of the toner use amount, with respect to each page (step S3).

When the drawing controller 52 finishes the image processing and the calculation of the toner use amount, the print controller 51 causes the engine controller 53 to start the secondary feeding of the printing sheet (step S4). After step S4, the print controller 51 sets the target fixing temperature for the secondary fixing temperature control (hereinafter, "secondary target fixing temperature") according to the toner use amount and the color information, notifies the secondary target fixing temperature to the engine controller 53, and causes the engine controller 53 to start the secondary fixing temperature control (step S5). The engine controller 53 controls the primary fixing temperature, so as to match the temperature of the fixing heater 9A with the secondary target fixing temperature. In other words, in the secondary fixing temperature control, the engine controller 53 adjusts the temperature of the fixing heater 9A so as to accord with the primary target fixing temperature, from the primary target fixing temperature. Therefore, the adjustment range of the fixing temperature becomes smaller in the secondary fixing temperature control, and the fixing temperature of the fixing device 9 can reach the secondary target fixing temperature, in a short time.

After step S5, the print controller 51 causes the engine controller 53 to transfer the toner image from the intermediate transfer belt 4 to the printing sheet, transport the printing sheet to the fixing device 9, and cause the fixing device 9 to fix the toner image onto the printing sheet, at the secondary target fixing temperature (step S6). After the fixing process, the printing sheet is discharged.

Now, in the case of uniformly determining the fixing temperature according to the type of sheets or the printing mode, as with the first and the second image forming apparatus referred to above, the appropriate fixing temperature may fail to be set, for the toner image to be printed (i.e., fixed).

In addition, in the case of controlling the fixing temperature according to the amount of toner applied to the printing sheet, as with the third image forming apparatus referred to above, the control of the fixing temperature is started after the toner amount is identified. Therefore, it takes a long time to execute the printing operation, in other words the printing speed becomes slower.

With the arrangement according to the foregoing embodiment, in contrast, the print controller 51 receives the printing request. The drawing controller 52 executes the image processing to the page image designated by the printing request with respect to each page, to thereby identify the image to be drawn through the printing job, and determines the toner use amount required by the image to be drawn. The fixing device 9 fixes the toner image onto the printing sheet, the toner image corresponding to the image to be drawn and having been transferred to the printing sheet. The engine controller 53 controls the fixing temperature of the fixing device 9. More specifically, the engine controller 53 controls the primary fixing temperature, according to color information designated by the printing request with respect to each page, and then controls the secondary fixing temperature, after the primary fixing temperature is executed and the toner use amount is determined, on the basis of the toner use amount determined.

Therefore, the printing operation can be executed in a relatively short time, and at the appropriate fixing temperature.

Various changes and modifications to the foregoing embodiment are obvious to those skilled in the art. Such changes and modifications may be made without departing from the scope and spirit of the subject, and without compromising the intended advantages. Thus, such changes and modifications are encompassed in the scope of the appended claims.

For example, although the image forming apparatus 1 according to the foregoing embodiment is based on an indirect transfer method, the image forming apparatus 1 may employ a direct transfer method.

The disclosure is applicable, for example, to an image forming apparatus based on electrophotography.

While the present disclosure has been described in detail with reference to the embodiments thereof, it would be apparent to those skilled in the art the various changes and modifications may be made therein within the scope defined by the appended claims.

What is claimed is:

1. An image forming apparatus comprising:

a fixing device that fixes a toner image onto a printing sheet to which the toner image corresponding to an image to be drawn by printing; and a controller including a processor, and configured to act, when the processor executes a control program, as:

a print controller that receives a printing request;

a drawing controller that identifies an image to be drawn, through image processing of a page image designated by the printing request with respect to each page, and identifies a use amount of toner required for the image to be drawn; and an engine controller that controls a fixing temperature of the fixing device, the engine controller being configured to:

execute a primary fixing temperature control including controlling the fixing temperature according to color information designated by the printing request with respect to each page; and execute, after executing the primary fixing temperature control, a secondary fixing temperature control including controlling the fixing temperature according to the use amount of toner identified by the drawing controller, wherein the engine controller executes the primary fixing temperature control during a primary feeding of the printing sheet, and executes the secondary fixing temperature control during a secondary feeding of the printing sheet.

2. The image forming apparatus according to claim 1, wherein the engine controller executes the secondary fixing temperature control according to both of the color information and the toner use amount.

3. The image forming apparatus according to claim 1, wherein the drawing controller identifies the toner use amount, on a basis of a number of toner dots of the image to be drawn.

4. The image forming apparatus according to claim 1, wherein the print controller sets a primary target fixing temperature according to the color information, the engine controller executes the primary fixing temperature control so as to match the fixing temperature with the primary target fixing temperature, the print controller sets a secondary target fixing temperature according to the toner use amount and the color information, and the engine controller executes the secondary fixing temperature control so as to match the fixing temperature with the secondary target fixing temperature.

* * * * *